US009656379B2

(12) United States Patent
Doster, Jr.

(10) Patent No.: US 9,656,379 B2
(45) Date of Patent: May 23, 2017

(54) MULTI-PURPOSE DRYWALL INSTALLATION TOOL

(71) Applicant: John E. Doster, Jr., Tiverton, RI (US)

(72) Inventor: John E. Doster, Jr., Tiverton, RI (US)

( * ) Notice: Subject to any disclaimer, the term of this patent is extended or adjusted under 35 U.S.C. 154(b) by 321 days.

(21) Appl. No.: 14/622,894

(22) Filed: Feb. 15, 2015

(65) Prior Publication Data

US 2015/0231776 A1 Aug. 20, 2015

Related U.S. Application Data

(60) Provisional application No. 61/940,787, filed on Feb. 17, 2014.

(51) Int. Cl.

| | |
|---|---|
| ***B25F 1/00*** | (2006.01) |
| ***B25D 1/04*** | (2006.01) |
| ***E04F 21/18*** | (2006.01) |

(52) U.S. Cl.

CPC ..... *B25F 1/006* (2013.01); *B25D 1/04* (2013.01); *E04F 21/18* (2013.01); *E04F 21/1894* (2013.01)

(58) Field of Classification Search

CPC . B25F 1/006; B25D 1/04; B25D 1/045; E04F 21/18; E04F 21/1894

See application file for complete search history.

(56) References Cited

U.S. PATENT DOCUMENTS 266,045 A * 10/1882 Morriss ..... B25F 1/00 254/19
724,542 A * 4/1903 Brownell ..... B25D 1/04 254/26 R
738,753 A * 9/1903 Baggett ..... B25D 1/04 254/26 R
1,866,426 A * 7/1932 Siegrist ..... B25B 7/04 7/127
2,105,239 A * 1/1938 Bachtold ..... B25F 1/006 16/111.1
4,817,221 A * 4/1989 Ryan ..... B25F 1/02 30/123.7
4,944,203 A 7/1990 Miller
5,622,352 A * 4/1997 Swindoll ..... B25D 1/04 254/26 E
5,749,113 A 5/1998 Witter
6,460,210 B1 * 10/2002 Alpert ..... B25C 11/00 7/144
6,827,333 B1 * 12/2004 Lutz ..... B25D 1/045 254/26 E
7,350,440 B2 * 4/2008 Casolco ..... B25C 11/00 7/143
7,836,534 B2 * 11/2010 Simmons ..... B25D 1/045 140/123
2005/0283916 A1 * 12/2005 Gintz ..... B25D 1/00 7/144
2015/0328761 A1 * 11/2015 Busch ..... A01B 1/022 7/116

FOREIGN PATENT DOCUMENTS

CA 1180987 1/1985

* cited by examiner

*Primary Examiner* — David B Thomas
(74) *Attorney, Agent, or Firm* — ZIP Law PLLC; Claire Zopf

(57) ABSTRACT

A multi-purpose tool that provides a hammer, a hatchet, a cutting blade, a lift support, a screw puller and a rasp for use in the installation of drywall sheets used in constructing walls within buildings.

19 Claims, 13 Drawing Sheets

MULTI-PURPOSE DRYWALL INSTALLATION TOOL

RELATED APPLICATION

This application claims the benefit of U.S. Provisional Patent Application No. 61/940,787 filed Feb. 17, 2014 entitled MULTI-PURPOSE DRYWALL INSTALLATION TOOL which is hereby incorporated herein by reference in its entirety.

FIELD OF THE INVENTION

The present invention is related to a multi-purpose tool that comprises a hammer, a hatchet, a cutting blade, a lift support, a screw and/or nail puller and a rasp for use in the removal and installation of drywall sheets used in constructing walls within buildings.

BACKGROUND OF THE INVENTION

The installation of drywall, plasterboard, or sheetrock requires a number of specialized tools to mount and hang the heavy paper-wrapped gypsum sheets. The drywall sheet normally ranges from 4×8 foot sheets to 4×12 foot sheets that must be arranged and held along the support studs that form the frame of the wall or ceiling and then be screwed, nailed or otherwise attached using suitable fasteners to the support studs. Full sheets may be mounted vertically or preferably horizontally along the studs and be cut to the proper dimensions to form the walls and ceiling of a room. Commonly, the sheets are mounted to the studs in an offset alignment to prevent seams from one sheet aligning along the entire length or width of a room. Tape is applied along the seams and filler is used over screw holes to provide a smooth surface for the drywall panels to be ready for paint or plaster to finish off the room.

Tools of the prior art for the installation of the drywall sheets may be a blade or utility knife to cut the drywall sheets to the proper dimensions; a hammer to pound nails and/or demolish and remove older wall coverings; a hatchet to cut and remove older plaster and drywall from a room being remodeled; a screw and/or nail puller to pull out misaligned screws or remove screws left in the studs after removing the old drywall and wall coverings; a lift support that has an extended flat metallic strip with a tapered point on one end that may be inserted under a drywall sheet and then be pivoted on a base leg by stepping on the opposing end of the metallic strip to provide for a sheet to be lifted and held in place for attachment of the sheet to the studs; and/or a rasp that is also required to smooth edges of the drywall after cutting to have the drywall sheets cleanly fit together along a seam.

An installer must have all of these tools readily available to properly and efficiently install the drywall sheets and finish the walls and ceilings of a room. Having a number of different tools presents the common problems of hauling all of the right equipment to a job sight and retrieving all of the tools when a job is complete, so that no tools are inadvertently left and lost, a costly mistake for any professional. What is needed is a multi-purpose tool that is easy to use and carry and that performs most of common tasks in removing drywall from older walls and ceilings and installing new drywall to form walls within a building.

SUMMARY OF THE INVENTION

The present invention is related to a multi-purpose tool that has a single handle for a user to grip, swing, twist or pry in order to operate a number of tool fixtures integrated to the handle. The handle may be similar in construction to that of a hammer and may be formed with a plastic, rubber, or taped grip around a first section to protect a user's hand when using the multi-purpose tool. The grip extends to a distance to cover approximately one third of the length of the handle. From the handle, a medial body portion extends to a tool head unit having a hammerhead portion radially extending from the medial portion and an opposing hatchet portion. The hatchet portion may have a sharpened blade along the bottom corner to be used to cut along the drywall sheets. In between the hammer and hatchet portion, a screw puller may extend axially. On a first surface along the medial portion, a rasp tool having a grinding surface may be formed or be attached. On the opposing surface of the medial portion, one or more support legs may extend to provide a lift support to use as a lever and hold a drywall panel off of the floor to properly align the sheet with other drywall sheets and attach the sheet to the wall support studs. In some embodiments, an angled claw or pry bar may extend from the support legs to give added leverage and grip to pull and remove nails from studs and wall coverings. In this manner, any tool can be manipulated by gripping the handle and swinging, pounding, prying, leveraging or grinding to use each of the tools that are all accessible in the one multi-purpose tool of the present invention.

These and other features, advantages and improvements according to this invention will be better understood by reference to the following detailed description and accompanying drawings.

BRIEF DESCRIPTION OF THE DRAWINGS

Several embodiments of the present invention will now be described by way of example only, with reference to the accompanying drawings in which.

DETAILED DESCRIPTION OF THE DRAWINGS

Figure 1:
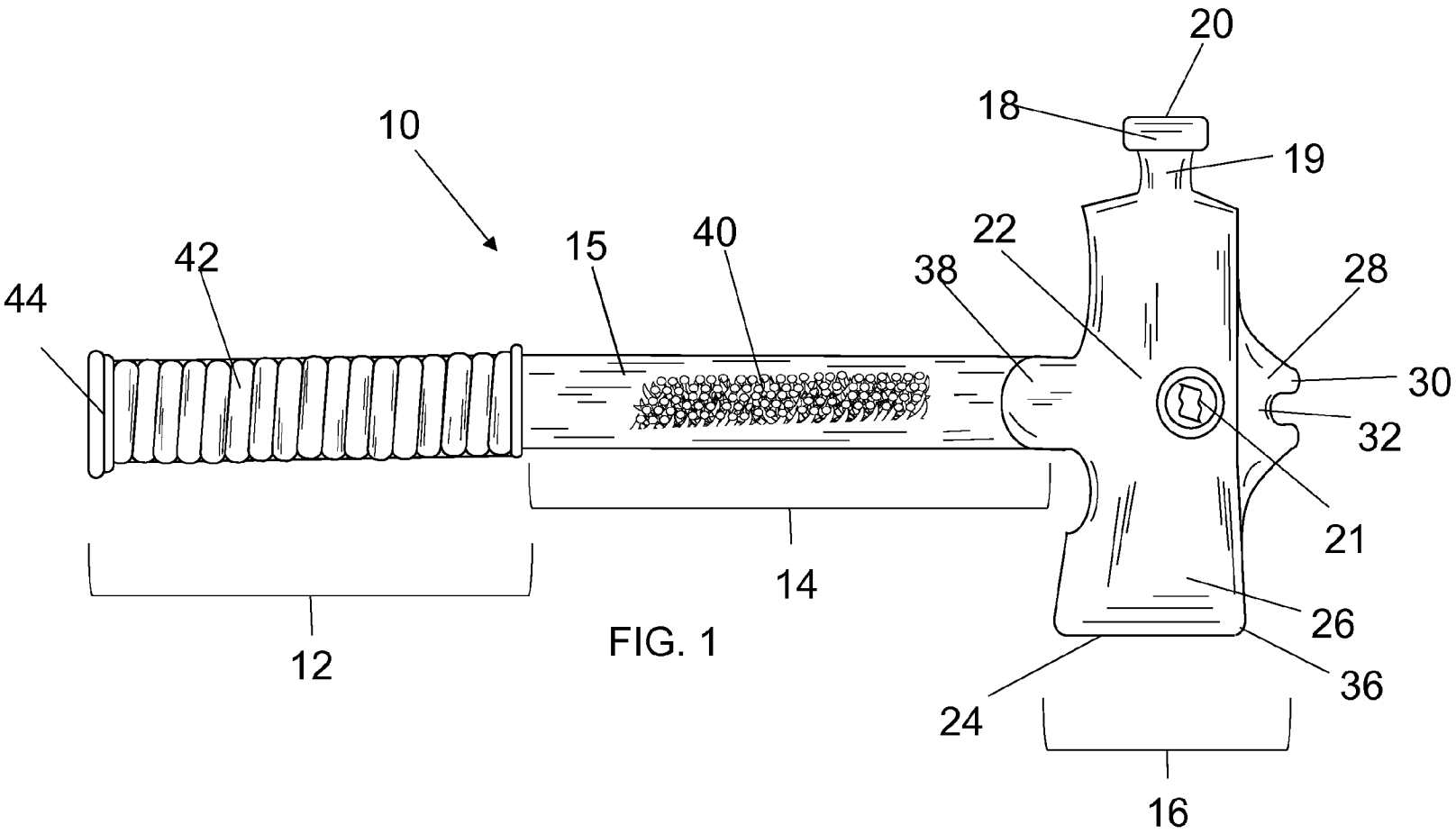
FIG. 1 is an upper side view of a an embodiment of the multi-purpose tool of the present invention with an integrated rasp tool.

As shown in FIG. 1, the multi-purpose drywall installation tool 10 has a first handle portion 12, a medial portion 14, and a tool head 16. The present invention may be formed as a single piece of forged steel, titanium, or other metallic compounds or in combination with other materials of wood or composite plastics having acceptable rigidity and strength. A hammerhead portion 18, as part of the tool head 16, may be formed with a milled convexly curved forwardly facing striking surface 20 extending from a milled cylindrical neck 19. The neck 19 extends in a first direction from a central milled marginal surface 22. A milled blade portion 24 forming the hatchet 26 extends from the central milled marginal surface 22 of the tool head 16 in a direction opposite to the first direction, providing for the handle 12 to be utilized to swing the multi-purpose tool 10 in a first direction to pound a nail using the hammerhead portion 18, and swing the multi-purpose tool 10 in the opposing direction to chop through or otherwise demolish old wall coverings for removal using the hatchet portion 26. Extending from the top of the central milled area 22 of the tool head 16, a screw and/or nail puller 28 may be formed. First and second milled tabs 30 extend forming a U-shaped support surface 32 of an adequate width to allow for the tabs 30 to be inserted below a screw head, nail, or other fastener and using the mechanical advantage of the handle 12 or leveraging and pivoting on the support legs 34 against the surface of the wall or studs, a screw may be pulled out in removing old screws in remodeling or misaligned screws during installation. A counterweight may be affixed or a raised emblem 21 may be formed in the central milled area 22 to proportion the weight and balance the tool head 16 to more easily swing and maneuver the multi-purpose tool 10. The tool portion 16 may have substantially smooth rounded corners 36 extending around the hatchet blade 24. At the base 38 of the tool portion 16, the material may milled to narrow the width and form the medial portion 14 at an adequate dimension to support the tool portion 16, and reduce the overall weight of the multi-purpose tool 10 to make it easier to grip and use.

Figure 4:
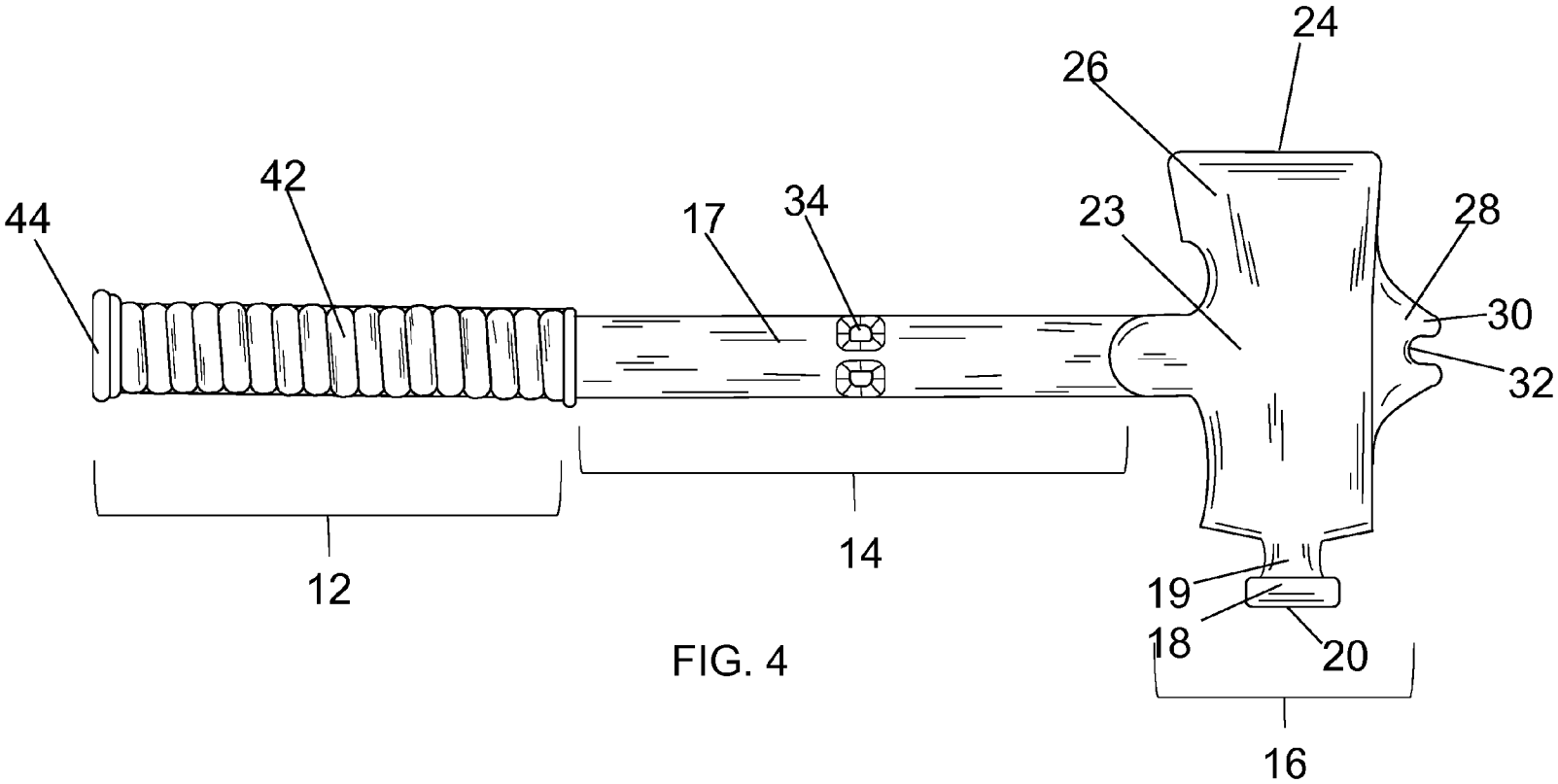
FIG. 4 is a lower side view of an embodiment of the multi-purpose tool of the present invention.

The multi-purpose tool 10 may be similar in dimension and weight to a standard hammer such as from 12"-18" in length and weighing between 10 and 32 ounces. The multi-purpose tool 10 of the present invention may be larger or smaller as necessary for the requirements of a particular job. The medial portion 14 may therefore extend to provide adequate separation from the tool portion 16 to easily use and maneuver each of the tools using the handle 12. Along an upper surface 15 of the medial portion 14, the surface 15 may be pitted and etched to form a grinding surface that may be used as a rasp 40 to remove rough edges or uneven surfaces formed during cutting of the drywall sheets. A drywall sheet is formed as heavy paper-wrapped gypsum or plaster sheets and may have erratic breaks in the plaster that unevenly extend from the edges of the paper wrap. By gripping the handle 12 and a lower surface 23 of the central surface area 22 of the tool portion 16 as shown in FIG. 4, the rasp 40 can be moved back and forth along an uneven edge to remove errant plaster pieces. The handle 12 may have a taped, rubber or plastic grip 42 with a rounded stopper 44 to cover the end of the handle 12 that may have sharp edges.

Figure 2:
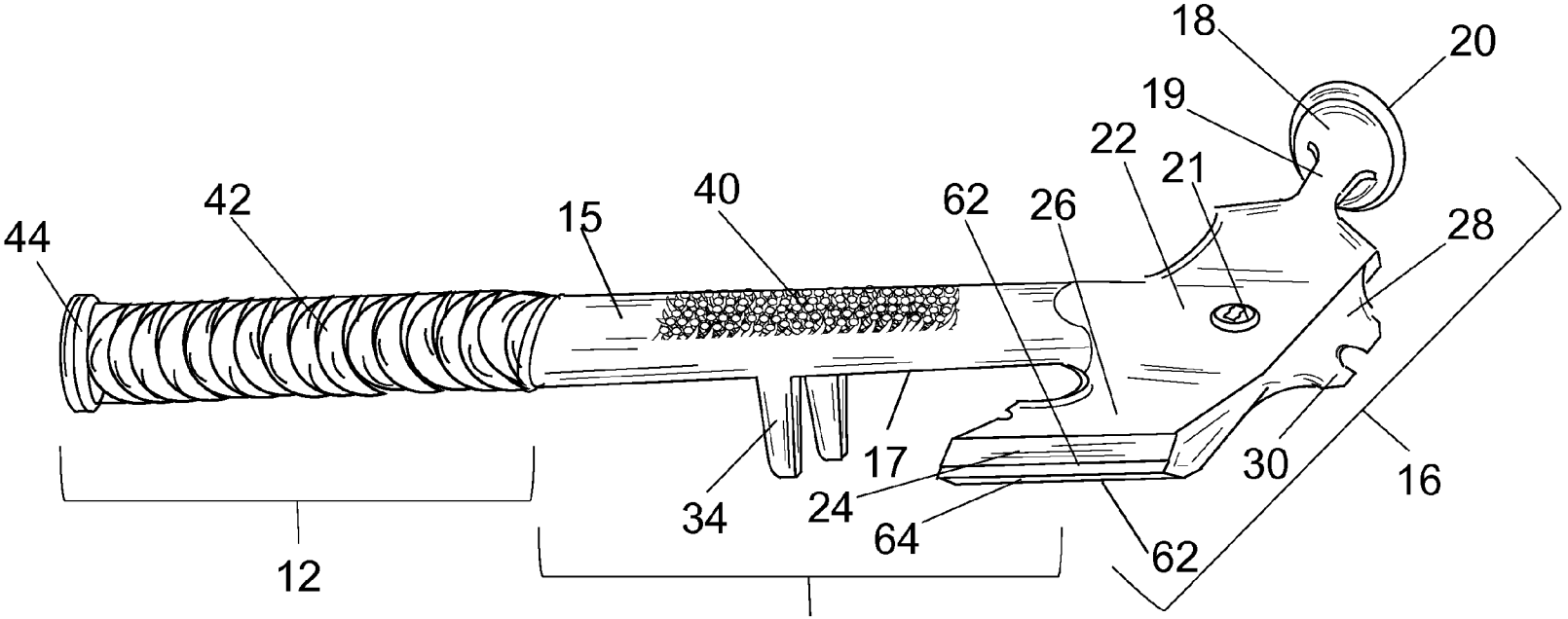
FIG. 2 is a perspective view of the embodiment of the multi-purpose tool of the present invention.
Figure 3A:
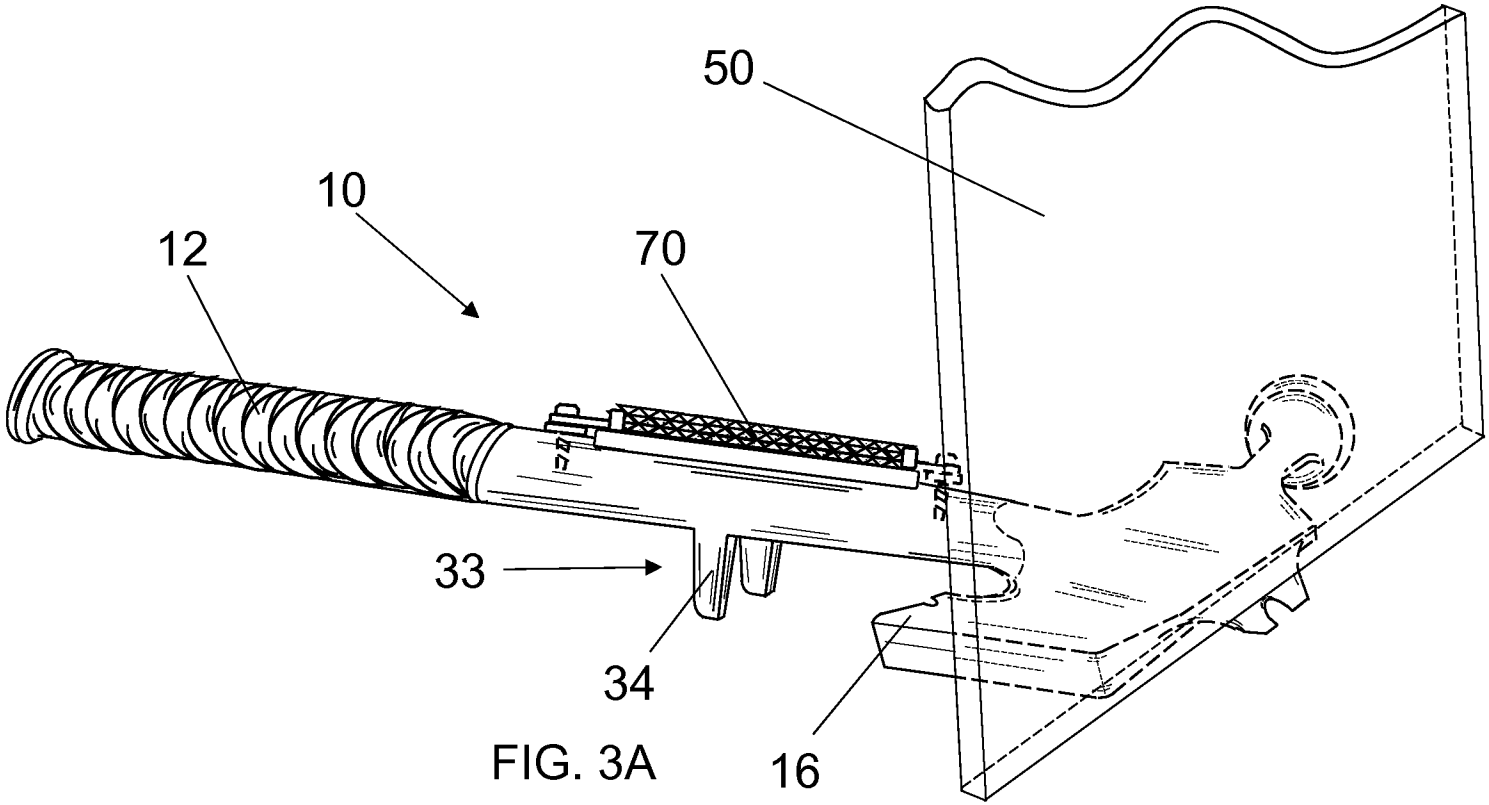
FIG. 3A is a perspective view of a further embodiment of the multi-purpose tool of the present invention with a replaceable rasp tool and the lift support inserted below a drywall sheet.
Figure 3B:
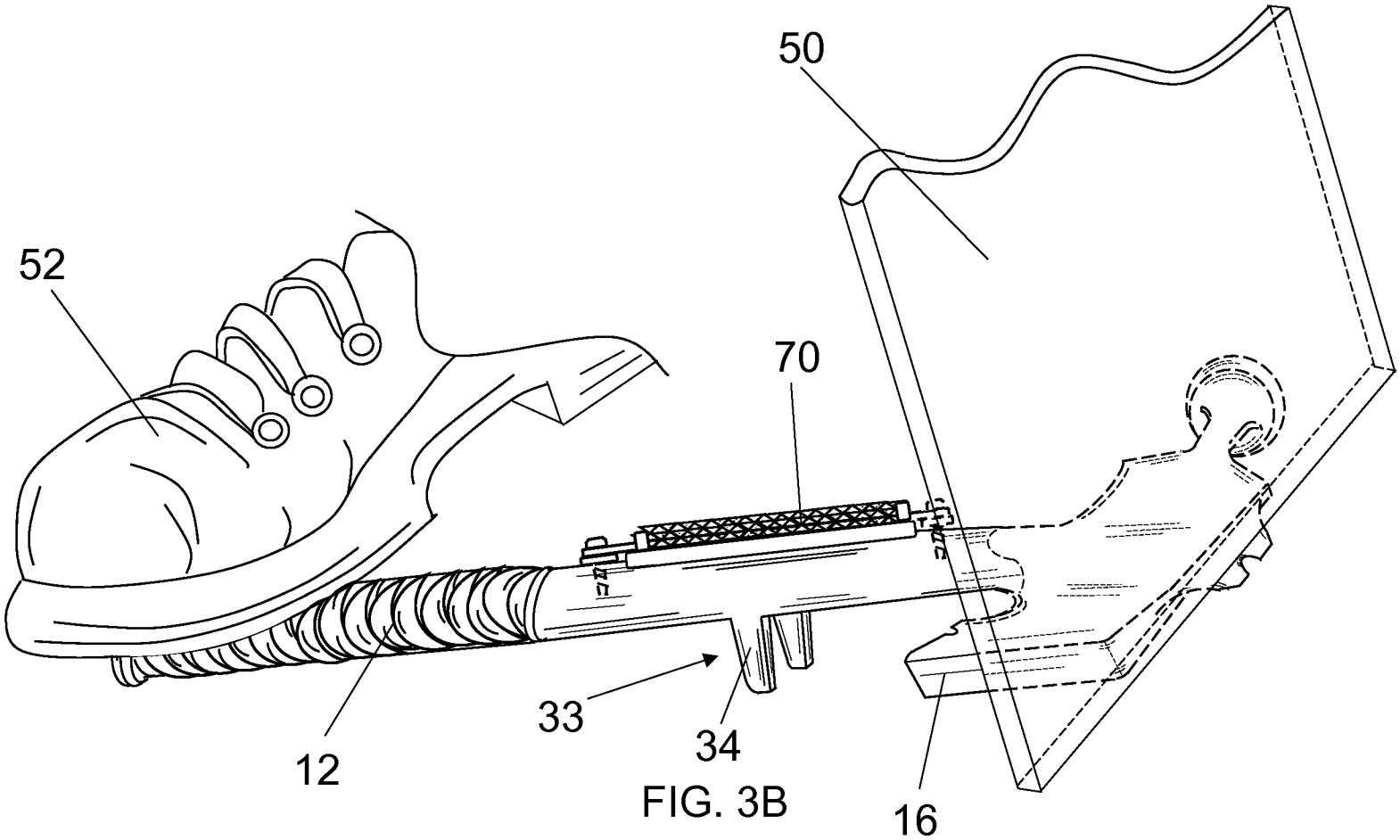
FIG. 3B is a perspective view of the further embodiment with the drywall sheet supported on the screw puller using the lift support of the multi-purpose tool of the present invention.
Figure 5:
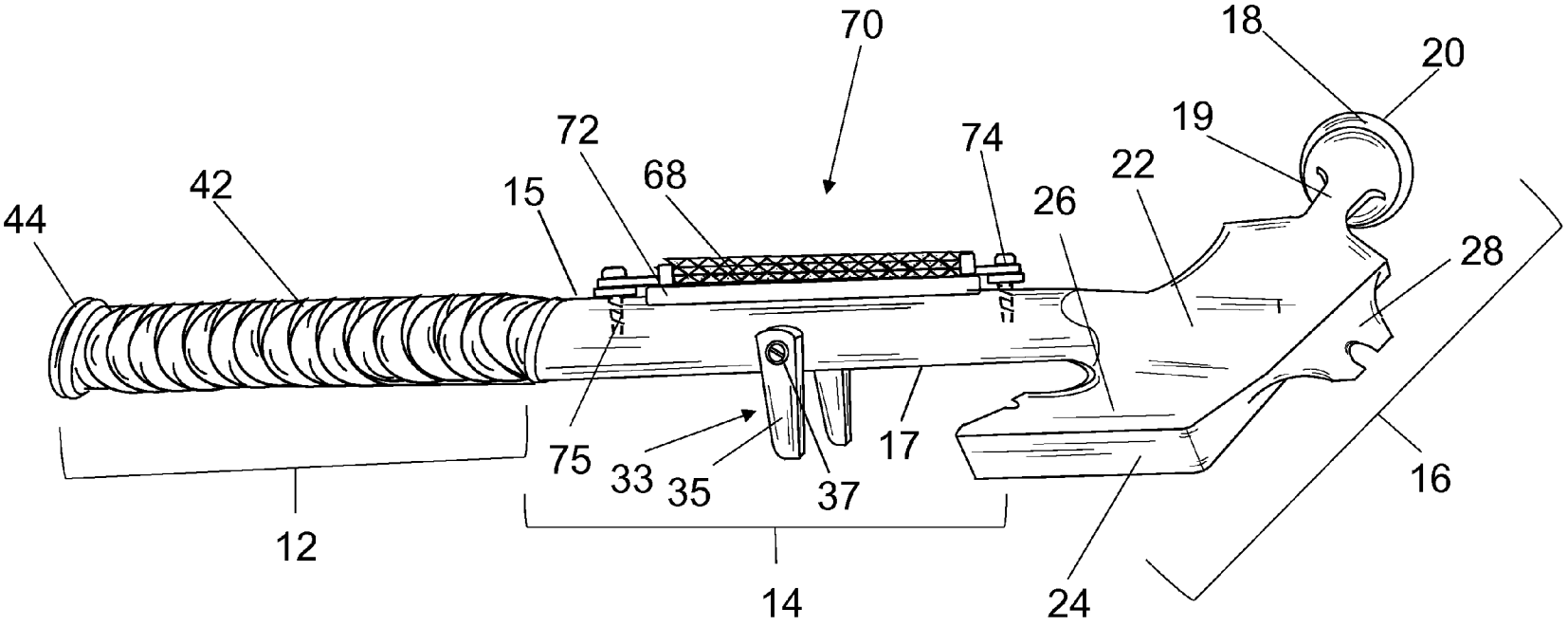
FIG. 5 is a perspective view of the further embodiment of the multi-purpose tool of the present invention with a detachable rasp tool.

As shown in FIG. 2, the blade 24 on the hatchet 26 of the multi-purpose tool 10 may have upper and lower hewed edges 62 to form a sharp edge 64. On the lower surface 17 of the medial portion 14, one or two legs 34 extend to provide for the entire tool 10 to be used as a lift support tool 33 by sliding the tabs 30 of the screw puller 28 under a sheet of drywall 50 as shown in FIG. 3A, and using the support legs 34 as a lever to pivot around and lift the drywall sheet 50 by applying pressure to the handle 12 of the multi-purpose tool 10 using for example the user's foot 52 as shown in FIG. 3B. Alternatively, the legs 35 may be affixed to the handle 12 using screws 37 or rivets, as shown in FIG. 5, to provide for the legs 35 to rotate and fold up to align the longer dimension of the legs 35 with the handle 12 for storage in a pouch or holster on a tool belt. The legs 35 may then be rotated to extend out from the multi-purpose tool 10 when the lift support tool 33 is needed. A bottom view of the multi-purpose tool 10 is shown in FIG. 4. The support legs 34 may be of any appropriate length and be positioned along the medial portion 14 at any appropriate position to provide the amount of lift required based on the overall length of the handle 12, medial portion 14 and tool head 16.

Figure 6:
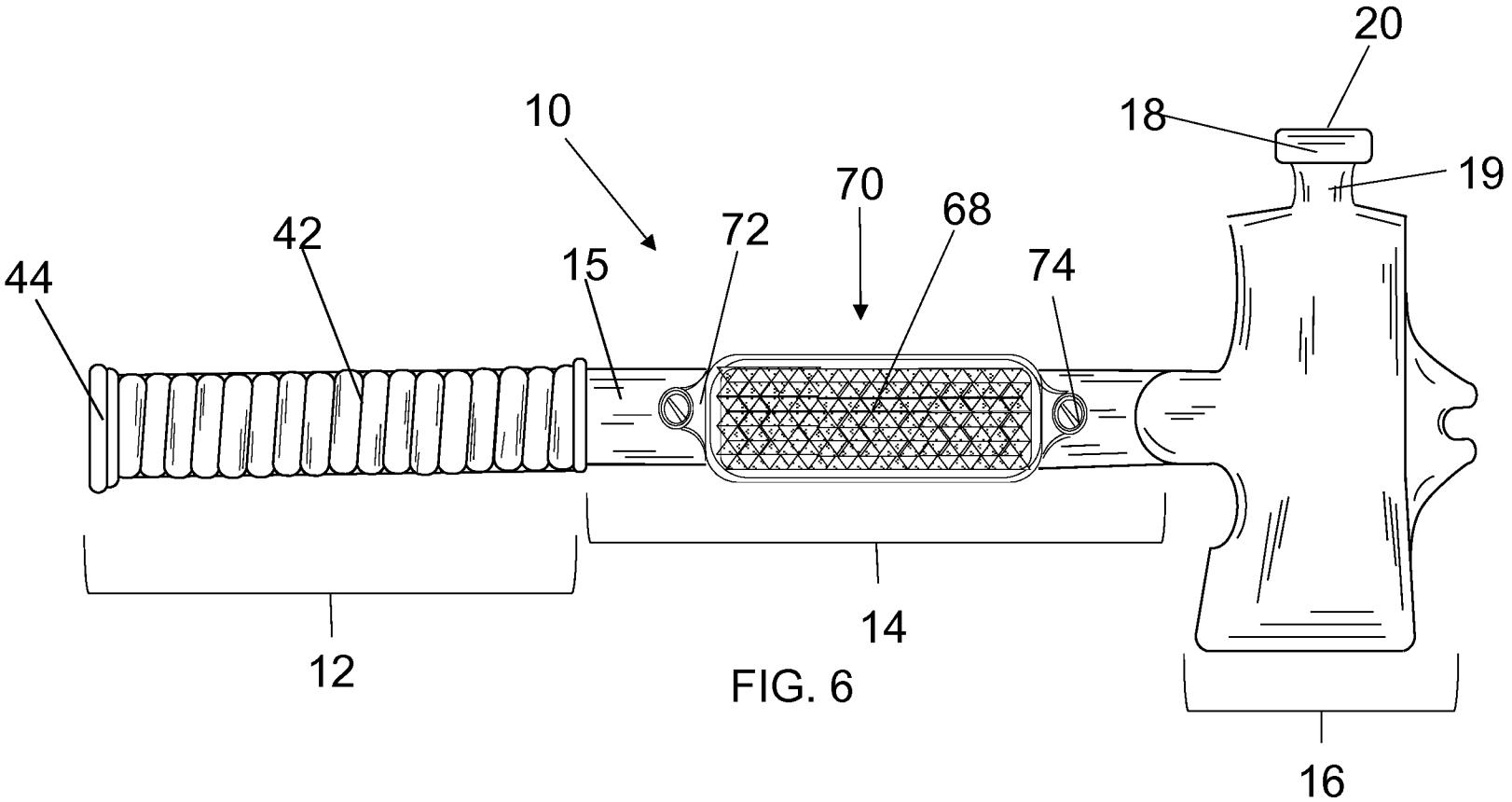
FIG. 6 is an upper side view of the further embodiment of the multi-purpose tool of the present invention with a detachable rasp tool.
Figure 7:
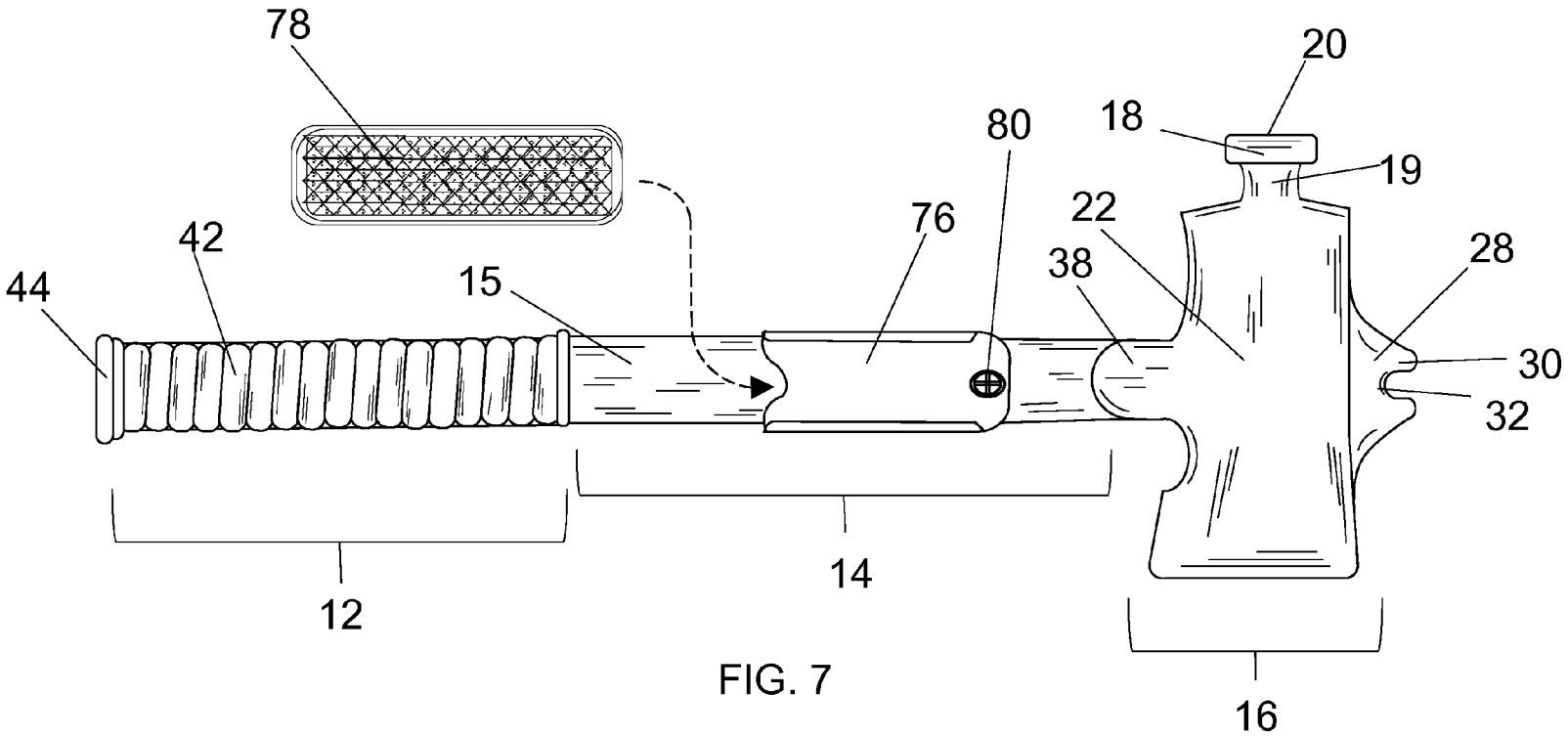
FIG. 7 is an upper side view of a still further embodiment of the multi-purpose tool of the present invention with a replaceable grinding surface of the rasp for insertion in an embodiment of a rasp tool holder in an embodiment of the multi-purpose tool of the present invention.

In a further embodiment, as shown in FIG. 5, the rasp tool 70 may be attached to the medial portion 14. A frame 72 of the rasp tool 70 may be affixed to the medial portion 14 using screws 74 or fasteners that are positioned in provided threaded holes 75 drilled into the upper surface 15 of the medial portion 14. The frame 72 may hold a grinding piece 68 that may be replaceable by removing the frame 72 from the multi-purpose tool 10. By having a detachable rasp tool 70 various grinding surfaces 68 may be installed as required by the type of gypsum or plaster used in the drywall sheets. The grinding surface 68 may further be set to an appropriate height as determined by the dimensions of the frame 72 or be adjusted as required by the grinding surface 68 by loosening or tightening the screws 74. An upper side view of the detachable rasp tool 70 is shown in FIG. 6. In further embodiments, a frame piece 76 may be semi-permanently attached to the upper surface 15 of the medial portion 14 using a screw 80 or other fastener as shown in FIG. 7. A replaceable rasp grinding surface 78 may then be slid into the frame piece 76 and be easily removed when worn by sliding the grinding surface 78 out and replacing with a new rasp grinding surface 78.

Figure 8A:
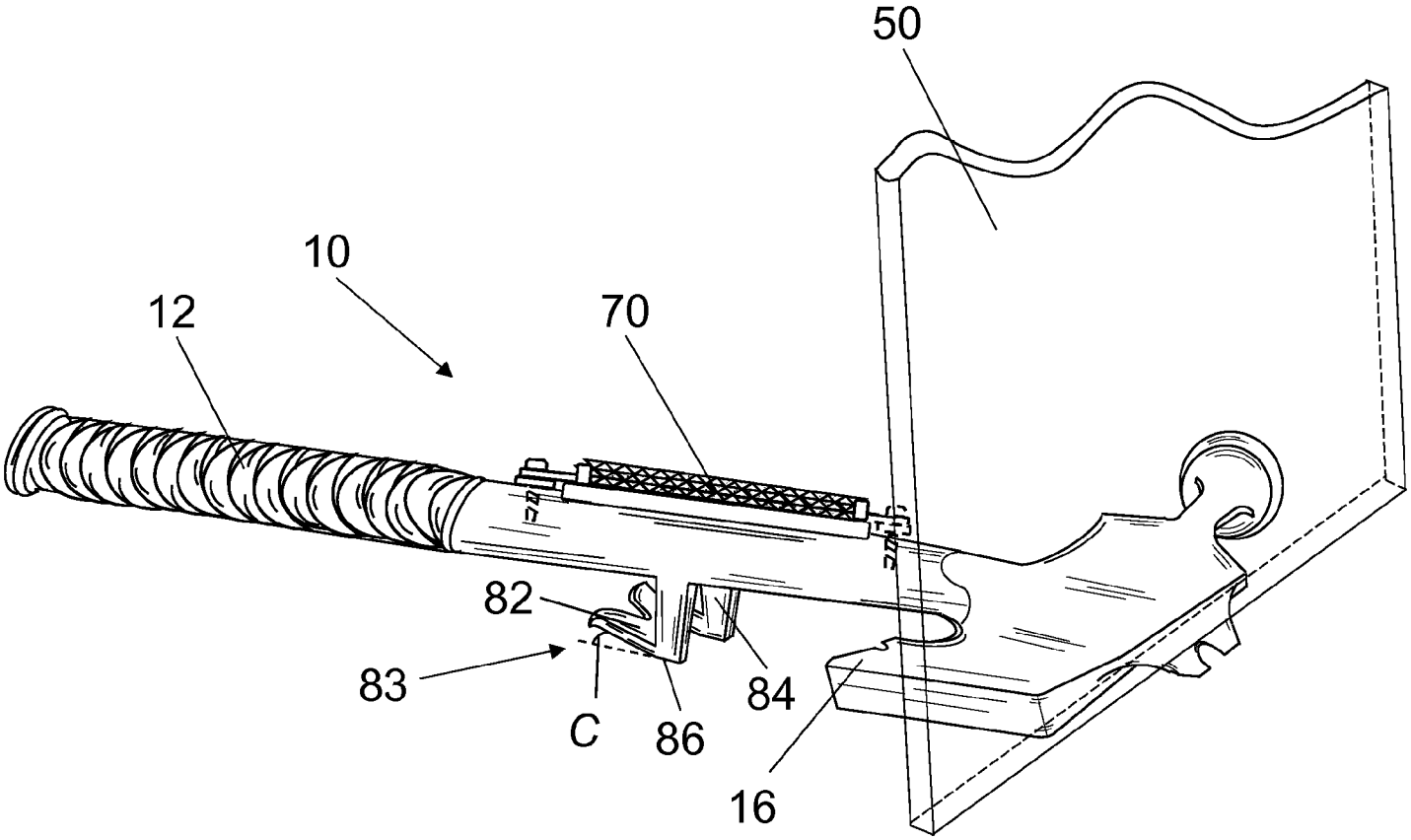
FIG. 8A is a perspective view of a further embodiment of the multi-purpose tool of the present invention with an angled claw lift support to lift a drywall sheet.
Figure 8B:
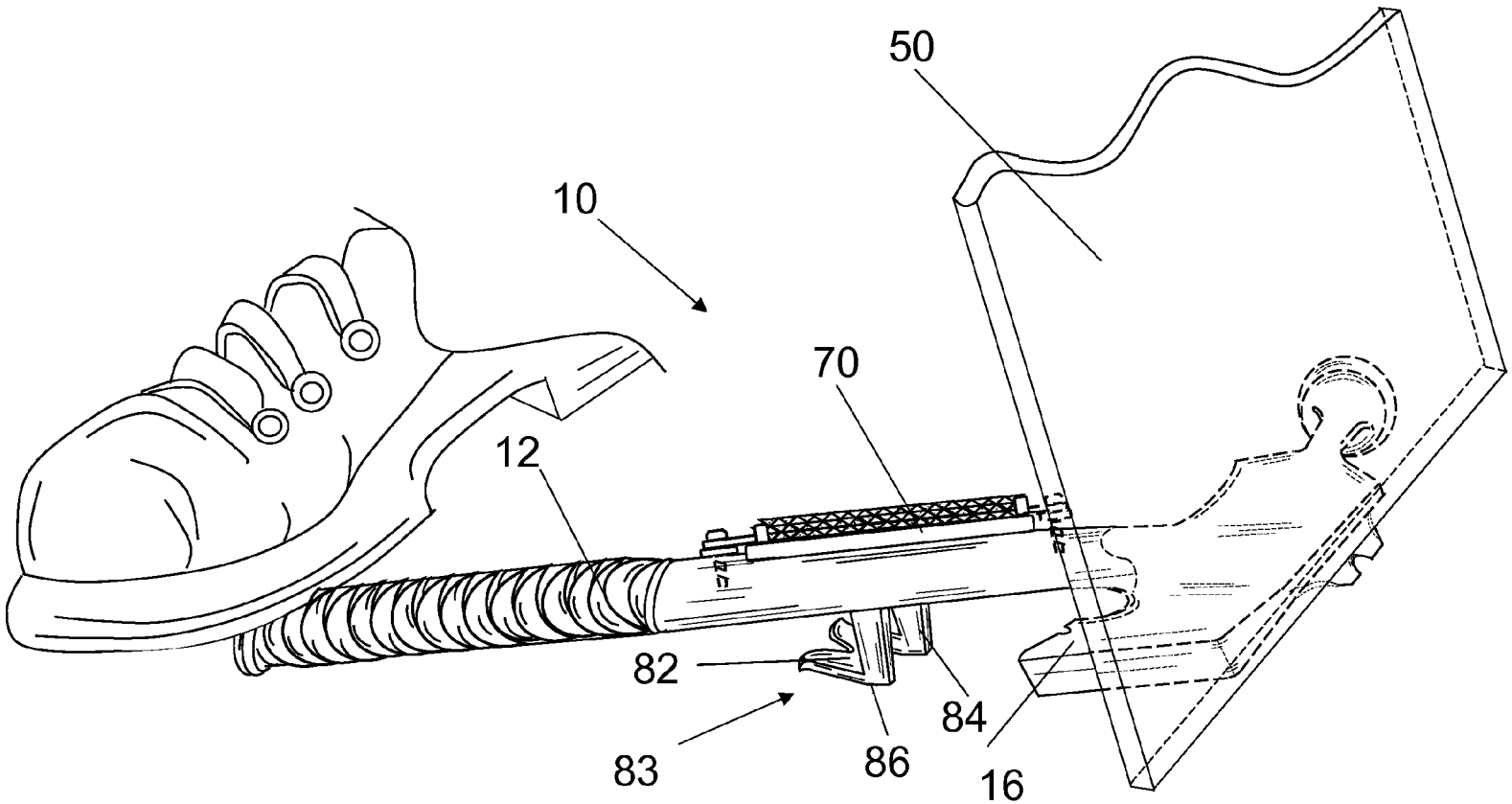
FIG. 8B is a perspective view of the further embodiment of the multi-purpose tool with the drywall sheet supported on the screw puller using the angled claw lift support.
Figure 9:
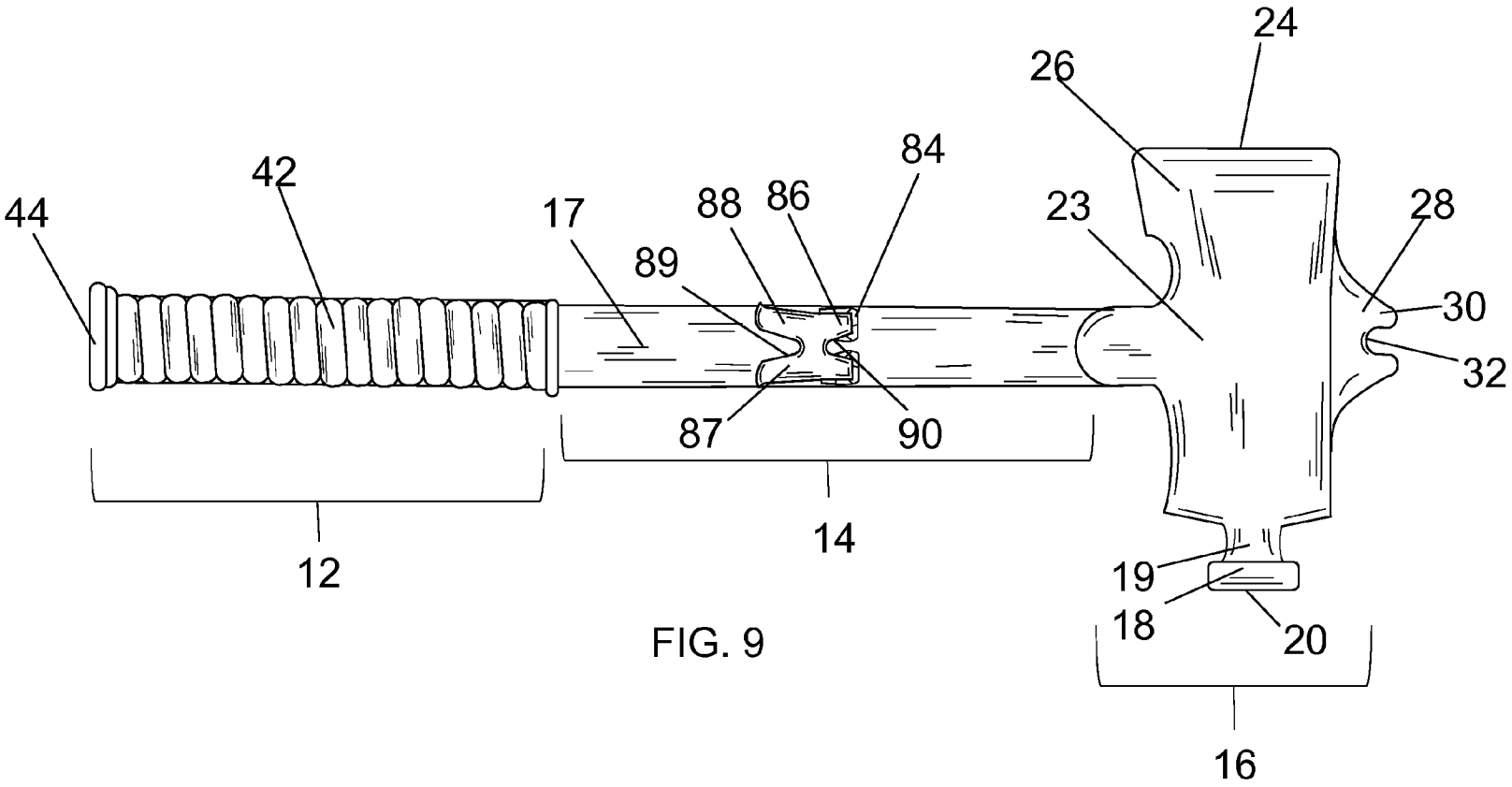
FIG. 9 is a lower side view of the further embodiment of the multi-purpose tool of the present invention with an angled claw lift support.
Figure 10:
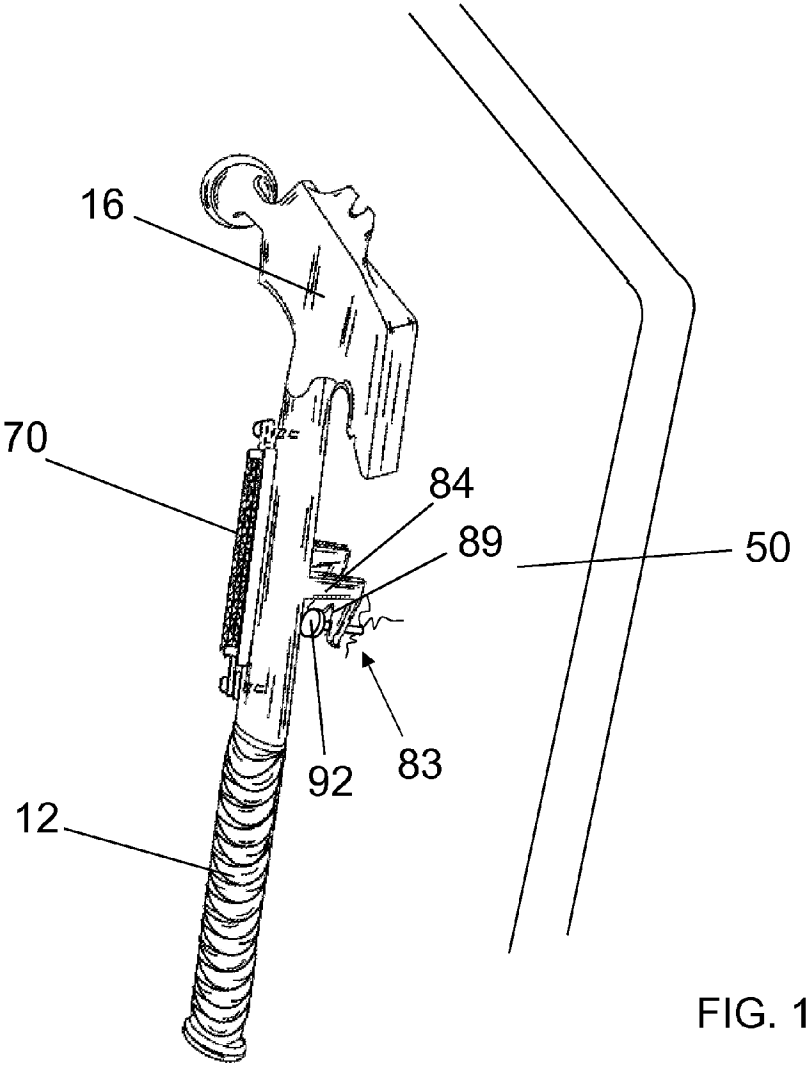
FIG. 10 is a perspective view of the further embodiment of the multi-purpose tool of the present invention with the angled claw lift support pulling a nail from a drywall sheet.

In other embodiments of the present invention, a lift support 83 may be formed having an angled claw 82 as shown in FIG. 8A that may provide additional leverage to remove screws and/or nails. The lift support 83 has legs 84 that extend from the handle 12. At the base 86 of the legs 84, the claw 82 extend at an angle C from the horizontal. The angle C is in a range of 10 to 30 degrees as determined by the length of the legs 84 and overall length of the multi-purpose tool 10 so that by sliding the tabs 30 of the screw puller 28 under a sheet of drywall 50, the lift support 83 may adequately lift the sheet 50 when pressure is applied to the handle 12, as shown in FIG. 8B. When lifting the dry wall sheet 50, the angled claw 82 may even rest on the ground or horizontal surface thereby setting the amount of lift based on the angle C of the angled claw 82. As shown in a lower side view in FIG. 9, the angled claw 82 is formed with two flattened prongs 87 and 88 that are separate by an opening shaped as a wedge 89. A second wedge 90 may be formed in between the base 86 of the legs 84 to provide for the lift support tool 83 to be used in either direction by either pushing the handle 12 to direct the second wedge around a nail or other fastener that must be removed, or by pulling the handle 12 to direct the first wedge 89 around a nail 92 and remove it from a sheet of drywall 50, as shown in FIG. 10, or from a stud, other wall covering or object. Additional leverage and grip within the first wedge 89 is provided by the angled claw 82 to pull the handle 12 downwards in this example of the nail 92 and then to lift upwards on the handle 12 to pull the nail 92 out of the drywall sheet.

Figure 11B:
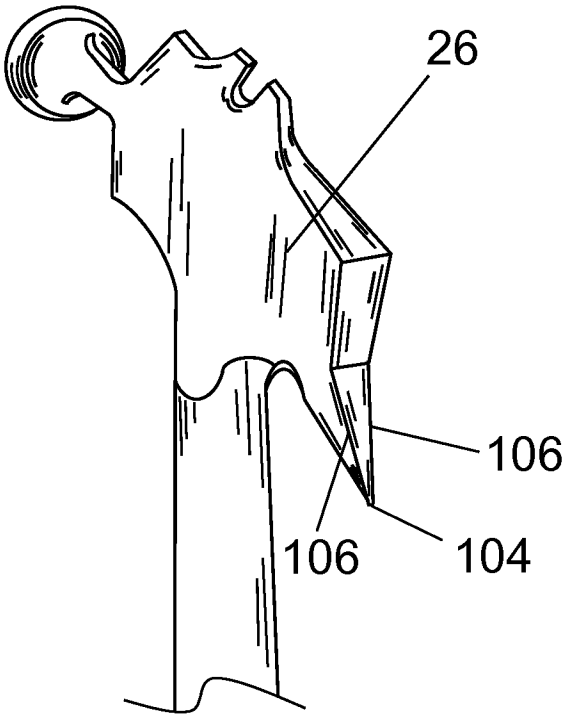
FIG. 11B is a perspective view of the embodiment of the multi-purpose tool of the present invention with the embodiment of the cutting tool with a blade formed at the lower corner of an embodiment of the hatchet of the present invention.
Figure 11A:
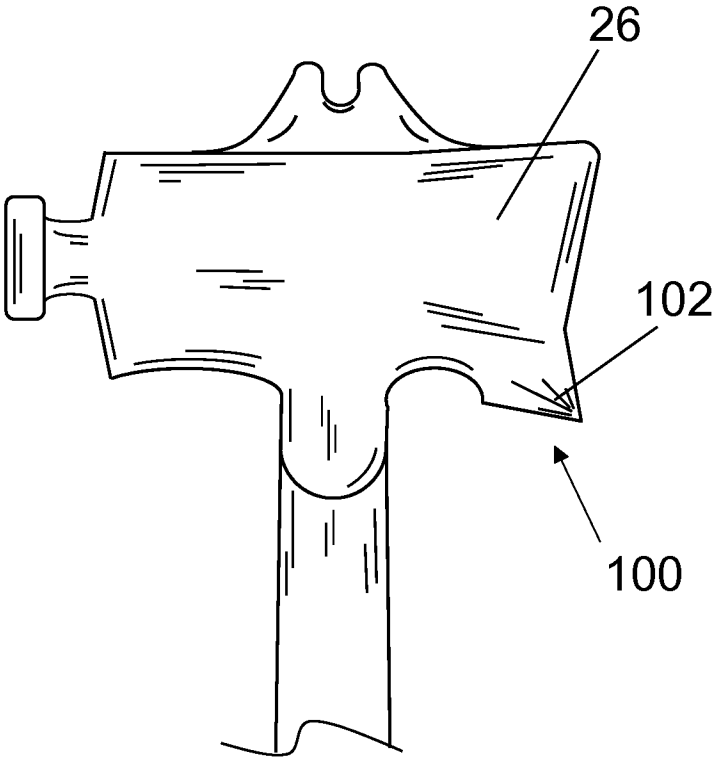
FIG. 11A is a side view of another embodiment of the multi-purpose tool of the present invention with an embodiment of a cutting tool with a blade formed at a lower corner of an embodiment of the hatchet of the present invention.

In a further embodiment, the hatchet 26 may be formed with a cutting blade 100 to score and cut the drywall sheets 50 as shown in FIG. 11A. The tool head 16 may be manufactured using a hardened carbon or tool steel or other sturdy metallic compound that may have a tool surface that may be sharpened providing for at least one corner 102 of the hatchet 26 to be honed into a point 104 having tapered sides 106, as shown in FIG. 11B. Similar to a utility knife, the honed point 104 provides a sharpened cutting blade 100 that may be dragged along the paper surface of a drywall sheet 50 to score or cut through the paper. The gypsum or plaster within the drywall sheet 50 may be broken along the score to properly size the sheets 50 for installation. By positioning the cutting blade 100 at the lower corner 102 of the hatchet 26, the handle 12 may be pulled along the drywall sheet 50 to cut into and through the paper.

The multi-purpose tool 10 having all or some of the tools of a hammer 18, a hatchet 26, a cutting blade 100, a lift support 33, a screw puller 30, an angled claw 82, and a rasp 70 in various embodiments as described herein provides a single tool that can be used in place of and as easily as a number of other tools and provide all of the necessary tool functions for the removal and installation of drywall sheets 50 used in constructing walls within a building.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention.

What is claimed is:

1. A multi-purpose tool for the installation of drywall, comprising:
- a handle;
- a medial portion extending from the handle;
- a rasp positioned along the medial portion;
- a tool head extending from the medial portion, the tool head having a hammer and a hatchet.

2. The multi-purpose tool for the installation of drywall of claim 1, comprising a screw puller extending from the tool head.

3. The multi-purpose tool for the installation of drywall of claim 2, comprising:
- at least one support leg extending from the medial portion; and
- wherein the screw puller may be inserted beneath a drywall sheet and the drywall sheet is lifted by applying pressure to the handle and pivoting the multi-purpose tool on the at least one support leg.

4. The multi-purpose tool for the installation of drywall of claim 3, wherein the at least one support leg has an angled claw.

5. The multi-purpose tool for the installation of drywall of claim 1, comprising a cutting blade formed at a lower corner of the hatchet.

6. The multi-purpose tool for the installation of drywall of claim 1, wherein the rasp is replaceable.

7. The multi-purpose tool for the installation of drywall of claim 1, wherein a grinding surface of the rasp is replaceable.

8. A multi-purpose tool for the installation of drywall, comprising:
- a handle;
- a medial portion extending from the handle;
- at least one support leg extending from the medial portion
- a tool head extending from the medial portion, the tool head having a hammer, and a screw puller; and
- wherein the screw puller may be inserted beneath a drywall sheet and the drywall sheet is lifted by applying pressure to the handle and pivoting the multi-purpose tool on the at least one support leg.

9. The multi-purpose tool for the installation of drywall of claim 8, wherein the at least one support leg has an angled claw.

10. The multi-purpose tool for the installation of drywall of claim 8, comprising a hatchet formed in the tool head.

11. The multi-purpose tool for the installation of drywall of claim 10, comprising a cutting blade formed at a lower corner of the hatchet.

12. The multi-purpose tool for the installation of drywall of claim 8, comprising a replaceable rasp positioned along the medial portion.

13. The multi-purpose tool for the installation of drywall of claim 8, comprising a rasp having a replaceable grinding surface positioned along the medial portion.

14. The multi-purpose tool for the installation of drywall of claim 8, wherein the at least one support leg folds up to align with the handle.

15. A multi-purpose tool for the installation of drywall, comprising:
- a handle;
- a medial portion extending from the handle;
- a tool head extending from the medial portion, the tool head having a hammer, a screw puller, and a hatchet;
- at least one support leg extending from the medial portion; and
- wherein the screw puller may be inserted beneath a drywall sheet and the drywall sheet is lifted by applying pressure to the handle and pivoting the multi-purpose tool on the at least one support leg.

16. The multi-purpose tool for the installation of drywall of claim 15, wherein the at least one support leg has an angled claw.

17. The multi-purpose tool for the installation of drywall of claim 15, comprising a cutting blade formed at a lower corner of the hatchet.

18. The multi-purpose tool for the installation of drywall of claim 15, comprising a replaceable rasp.

19. The multi-purpose tool for the installation of drywall of claim 15, comprising a rasp having a replaceable grinding surface.

* * * * *